US006170881B1

(12) United States Patent
Salmon et al.

(10) Patent No.: US 6,170,881 B1
(45) Date of Patent: Jan. 9, 2001

(54) PSEUDO THREE-DIMENSIONAL IMAGE DISPLAY AND METHOD OF MANUFACTURING INCLUDING REFLECTIVE MONOCHROME OR HOLOGRAPHIC ROLL LEAFING

(75) Inventors: Joseph P. Salmon; Eugene M. Dukatz, both of West Bend; Rashelle L. Ponchaud, Cascade, all of WI (US)

(73) Assignee: Serigraph, Inc., West Bend, IN (US)

( * ) Notice: Under 35 U.S.C. 154(b), the term of this patent shall be extended for 0 days.

(21) Appl. No.: 08/794,331

(22) Filed: Feb. 3, 1997

(51) Int. Cl.[7] ..... B42D 15/00
(52) U.S. Cl. ..... 283/91
(58) Field of Search ..... 283/72, 91–94, 283/109, 101; 428/40.1, 40.9

(56) References Cited

U.S. PATENT DOCUMENTS 3,912,842 * 10/1975 Swartz ..... 428/172
4,933,218 * 6/1990 Longobardi ..... 428/38
5,082,703 * 1/1992 Longobardi ..... 428/38
5,106,126 * 4/1992 Longobardi et al. ..... 283/94
5,714,213 * 2/1998 Antes et al. ..... 428/30
5,762,379 * 6/1998 Salmon et al. ..... 283/91

FOREIGN PATENT DOCUMENTS 56-115211 * 9/1981 (JP) .

* cited by examiner

*Primary Examiner*—Willmon Fridie, Jr.
(74) *Attorney, Agent, or Firm*—David G. Alexander; Arter & Hadden LLP

(57) ABSTRACT

A textured pattern including raised lines, bumps, etc. is formed of ink on a front surface of a base sheet. A layer of reflective monochrome or holographic roll leafing is formed over the textured pattern such that the surface of the leafing follows that of the pattern to simulate embossing. An ink image is formed over the front surface of the sheet in an area not occupied by the roll leafing, and an additional ink image can be formed over at least part of the roll leafing. A protective transparent layer is formed over the leafing and ink image. The base sheet can be transparent, and a reflective layer can be formed on a rear surface of the sheet to reflect light back through the sheet and transparent portions of the ink image. Alternatively, the base sheet can be opaque, and an additional ink image can be formed on the rear surface of the sheet.

27 Claims, 4 Drawing Sheets

PSEUDO THREE-DIMENSIONAL IMAGE DISPLAY AND METHOD OF MANUFACTURING INCLUDING REFLECTIVE MONOCHROME OR HOLOGRAPHIC ROLL LEAFING

CROSS-REFERENCE TO RELATED APPLICATION

This application discloses subject matter which is related to that of copending U.S. patent application Ser. No. 08/601,084, entitled "PRINTED ARTICLE", filed Feb. 14, 1996, by Joseph P. Salmon et al.

BACKGROUND OF THE INVENTION

1. Field of the Invention

The present invention relates to a method of manufacturing a printed article having a pseudo three-dimensional image display including reflective monochrome or holographic roll leafing. Examples of such articles are trading cards, greeting cards, signs, posters, labels, decals, book covers, decorative panels, and name plates.

2. Description of the Related Art

Three-dimensional images are highly desirable due to the added visual impact provided by depth. Various methodologies have been proposed in the prior art to provide three-dimensional images using two-dimensional media.

One proposal involves printing two offset images in different colors on an opaque or transparent sheet, and viewing the images using special glasses having right and left lenses which correspond to the different image colors respectively. Where the sheet is transparent, the offset images can be projected onto a screen to produce a three-dimensional slide show or movie. Holographic technology can also be used to produce an image on a flat sheet which appears three-dimensional when illuminated and viewed at the proper angles.

However, these methodologies have not been commercially popular for various reasons. The offset image method is undesirable in that special glasses are required to view the image. Holograms are difficult and expensive to produce.

For this reason, processes have been proposed to produce pseudo three-dimensional images which are basically two-dimensional, but have some quality that simulates depth. One such process is conventional embossing, which forms a raised pattern on a business card or the like by physically deforming part of the card upwardly.

Conventional embossing, although practical in some applications, suffers from the drawback that an expensive press is necessary to perform the operation, and a die bearing the desired embossed pattern must be made for each application. The cost becomes prohibitive for large image displays such as signs, and the process is not usable at all for sheets made of materials such as glass which are not readily deformable at temperatures below their considerably high melting points.

U.S. Pat. No. 4,933,218, to L. Longobardi, discloses a method for producing a sign having an embossed appearance which does not require physical deformation. The method involves printing an extraordinarily thick ink pattern on the rear surface of a transparent sheet, and printing a transparent ink image in areas not occupied by the thick ink pattern. A reflective layer is then formed over the ink pattern and image.

The sign is viewed through the transparent sheet such that light is reflected back from the reflective layer through the ink pattern and image. The ink image has a normal two-dimensional appearance when thusly viewed. The thick ink pattern is formed around edge and other desired portions of the image to produce a pseudo three-dimensional effect which simulates embossing. An alternative is to produce an etched effect using a textured ink pattern rather than a thick ink pattern.

A variation of this method is disclosed in U.S. Pat. No. 5,082,703, also to Longobardi, in which the reflective sheet is replaced by a reflective stratum which can be sprayed onto the rear surface of the sheet.

U.S. Pat. No. 5,106,126, to L. Longobardi and D. Lovison, discloses a colored image consisting of a large number of small dots, in combination with a stratum of opaque white ink deposited between a reflective layer and preselected portions of the image to block passage of visible light from the preselected portions to the reflective layer. U.S. Pat. No. 5,223,357, to D. Lovison, discloses an arrangement similar to that of U.S. Pat. No. 5,106,126, in which the reflective layer is replaced by a holographic layer to present a variable color cast to the image.

A problem which exists with the Longobardi and Lovison proposals are that they require a transparent sheet of glass, plastic, etc., with the image being formed on a rear surface of the sheet which faces away from the viewer. These methods are not readily applicable to producing printed articles such as trading cards which have opaque, in this case cardboard, base sheets. More specifically, a second sheet on which the rear surface image is formed must be laminated to the rear surface of the transparent sheet.

Known lamination methods present certain problems. Not only does lamination add to the cost of producing two-sided objects, but misregistration (misalignment of the images on opposite sides of the sign, poster or card relative to one another) is often introduced during the lamination process. Through the structure and method of the present invention, this registration problem is greatly reduced if not eliminated.

A need therefore exists in the art for a method of producing a printed article having a pseudo three-dimensional image which can be advantageously applied to manufacturing two-sided trading cards and the like which have opaque base sheets.

SUMMARY OF THE INVENTION

It is an object of the present invention to provide a method for producing a printed or similarly produced article, which overcomes the drawbacks of the prior art, and enables a pseudo three-dimensional visual display to be formed on a surface of a base sheet which can be opaque as well as transparent.

In accordance with the present invention, a textured pattern including raised lines, bumps, etc. is formed of ink on a front surface of a base sheet. A layer of reflective roll leafing is formed over the textured pattern such that the surface of the leafing follows that of the pattern to simulate embossing. The roll leafing can be monochrome, or can alternatively be holographic to provide a variable color cast.

An ink image is formed over the front surface of the sheet in an area not occupied by the roll leafing, and an additional ink image can be formed over at least part of the roll leafing. A protective transparent layer is formed over the leafing and ink image.

The base sheet can be opaque, and typically formed of card stock having a white reflective front surface. In this case, a white shiny image area can be provided by the surface of the sheet itself without the necessity of printing ink in this area. In an exemplary case of an image having a large white background, substantial economy can be realized by not having to print ink in the background area. An additional ink image can be formed on the rear surface of the base sheet.

Alternatively, the base sheet can be transparent, and a reflective layer can be formed on a rear surface of the sheet to reflect light back through the sheet and transparent portions of the ink image. The reflective layer can be omitted in one or more areas to produce a clear or color tinted appearance which can be backlighted.

Articles produced in accordance with the present invention are superior to those produced by presently known production methods such as described above. For example, a two-sided article, such as a trading card, poster, decal or sign, may be produced by printing an image (such as player statistics in a sports trading card) on the side of the sheet opposite that which supports the textured pattern. This eliminates the need to laminate two separately printed articles to one another, the method presently used to produce two-sided cards.

These and other features and advantages of the present invention will be apparent to those skilled in the art from the following detailed description, taken together with the accompanying drawings, in which like reference numerals refer to like parts.

DETAILED DESCRIPTION OF THE INVENTION

Figure 1:
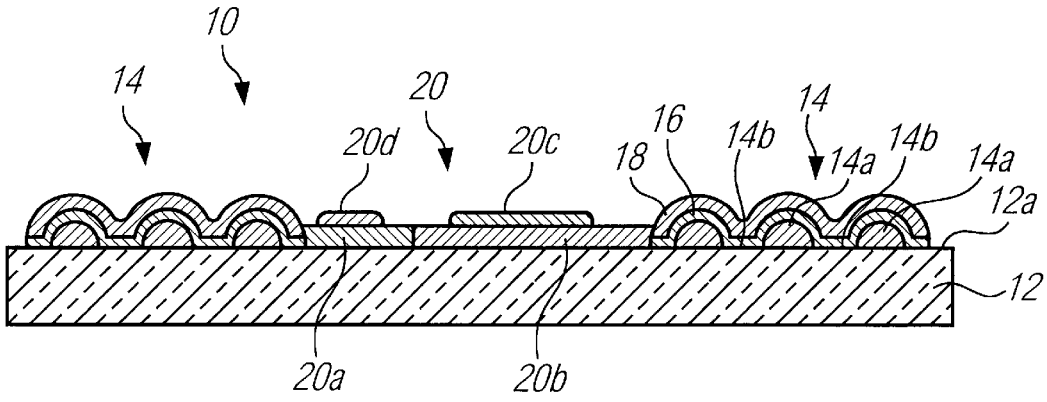
FIG. 1 is a cross-sectional view illustrating a pseudo three-dimensional image display formed on a printed article according to the present invention.

As illustrated in FIG. 1, a printed article 10 having a visual display formed thereon is manufactured in accordance with a method of the present invention. The article 10 includes a base sheet 12 which can be opaque or transparent, and flexible or rigid.

An opaque sheet 12 can be formed of paper, cardboard, metal, or any other suitable material. An opaque sheet is appropriate for producing trading cards, greeting cards, signs, posters, labels, book covers, decorative panels, name plates, and the like. Alternatively, the sheet 12 can be replaced by an object having a flat surface, such as the side of a building.

A transparent sheet 12 can be formed of plastic, glass, or any other suitable material. A transparent sheet is appropriate for producing decals and the like, and can also be used for producing other items as indicated above in combination with a rear surface reflective layer and protective cover as will be described in detail below.

An opaque sheet 12 is preferably formed from board or paper stock that is between 8.0 and 30.0 mils thick, although thicker or thinner stock may be used where the application requires. In applications such a trading cards, stock that is approximately 10.0 mils thick is typically used. The board or paper stock should be treated with a moisture stable coating that will prevent ink from being absorbed by the stock.

For applications where greater flexibility is required, such as decals, the base may be relatively thin or composed of a flexible plastic material. Conversely, thicker stock and rigid plastic may be used in applications where rigidity is required, such as free standing displays.

The sheet 12 has a front surface 12*a* which is typically flat, although the invention is not so limited. A textured pattern 14 is formed on the surface 12*a* which includes protrusions 14*a* in the form of lines, circular bumps, or any other suitable design. The textured pattern 14 also includes areas 14*b* of the surface 12*a* between the protrusions 14*a*.

The first step of the present method is to form the pattern 14 on the surface 12*a*. The pattern 14 is preferably formed by printing, although it can be formed using other methods such as hand painting. The preferred material of the pattern 14 is ink, although it can be formed of any other suitable material which is capable of adhering to the surface 12*a*.

The textured pattern 14 may be formed from a standard ink deposited onto a sheet 12 by processes including, but not limited to, silk screening, lithography, flexography, gravure, and coating. The ink is preferably of a type which cures in response to the application of ultraviolet light.

Although the thickness (height) of the textured pattern is approximately 1.0 mil to ensure visibility, the thickness may be made larger or smaller to suit particular applications. As is known in the art, if a thickness (height) greater than that which can be produced with a single silk screened layer is desired, then multiple layers may be applied one on top of the another until the desired thickness is attained.

After the pattern 14 is formed on the surface 12*a*, an adhesive layer 16 is formed over the pattern 14 using screen printing, offset printing, or any other suitable process. An appropriate adhesive is Rage 800 Clear Ink which is commercially available from Nazdar of Chicago, Ill., and preferably has a dry film thickness of approximately 0.2–0.5 mils.

Then, a reflective layer 18 is formed on the adhesive 16, such that the reflective layer 18 is adhered to the pattern 14 by the adhesive 16. The reflective layer 18 is preferably formed of monochrome (e.g. solid chrome) or holographic roll leafing.

Although not explicitly illustrated, the roll leafing is typically secured to a carrier, such as a polyester film, with a release layer therebetween. Pressure (as well as heat, if the adhesive 16 is heat activated) is applied to bond the roll leafing to the textured pattern 14. The carrier is then removed.

The roll leafing which is used to form the present reflective layer 18 is different from conventional roll leafing in that it does not have an adhesive on its exposed surface. Instead, the adhesive 16 is applied to the pattern 14.

Although the carrier with the roll leafing thereon is provided as a continuous sheet, the roll leafing is transferred from the carrier to the pattern 14 only where the adhesive 16 is present to form the reflective layer 18. Roll leafing in areas in which the adhesive 16 is not present remains attached to the carrier.

A suitable monochrome roll leafing material is MEZ5900 Chrome, which is commercially available from Astor Universal of Lenexa, Kans., and is applied using any conventional laminating technique which is available in the art for applying roll leafing. A suitable reflective holographic roll leafing is SEZ5995 Chrome Rainbow Holographic, which is also commercially available from Astor Universal.

Gold reflective and holographic roll leafing, as well as other types and colors of roll leafing, are also commercially available and are suitable for practicing the present invention. Although roll leafing is the preferred material for forming the reflective layer 18, the invention is not so limited, and any other suitable material can be used to form the reflective layer 18.

In some instances, some of the release coat will remain on the exposed surface of the roll leafing. As such, a primer (not shown) can be applied to the roll leafing to ensure that a subsequently applied ink image will stick to it. The primer may be water based, UV curable or conventional, and may be applied by lithography, silk screening or flexography.

As a result, the surface of the reflective layer 18 follows the surface of the pattern 14, with the portions of the reflective layer 18 overlying the protrusions 14*a* being raised above the neighboring areas 14*b* of the pattern 14. This produces an embossed effect which simulates a three-dimensional image.

Further illustrated in FIG. 1 are the results of performing a step of forming an ink image 20 on the surface 12*a* in an area not occupied by the textured pattern 14. The image 20 can include opaque ink, at least partially transparent or translucent ink, or any combination thereof.

As illustrated, the ink image 20 includes an area 20*a* formed of at least partially transparent or translucent ink, and an area 20*b* formed of opaque ink, on the surface 12*a*. Typically, the image 20 will be formed using a conventional four color printing process, using inks of three primary colors in combination with black ink. Suitable printing processes include lithography, silk screening, and gravure.

The image 20 can further include an area 20*c* of at least partially transparent or translucent ink formed on the opaque area 20*b*, and/or an area 20*d* of opaque ink formed on the transparent area 20*a*. The portion of the transparent ink area 20*a* underlying the opaque ink area 20*d* is not visible to the viewer, but may be included to simplify the printing of the entire image 20.

The opaque area 20*d* can be white as disclosed in the above referenced U.S. Pat. No. 5,106,126 to enhance the simulated depth effect. It is further within the scope of the invention to form transparent ink images on top of other transparent ink images, and opaque ink images on top of other opaque ink images, if doing so simplifies the printing process.

The opaque ink areas 20*b* and 20*d* present a conventional flat, two-dimensional appearance to a viewer. The transparent area 20*c* may be tinted with a color which is different from the underlying opaque area 20*b*, such that the colors of the areas 20*c* and 20*b* combine to produce a third color.

The base sheet 12 can be opaque, with the surface 12*a* being white or of any other suitable color. Light passing through the portion of the transparent ink area 20*a* which is not covered by the area 20*d* will be reflected back to the viewer, and the color of this portion of the area 20*a* will be a combination of the color of the tinting of the area 20*a* and the color of the surface 12*a*. In this arrangement, the transparent areas of the image 20 produce a different visual effect from the opaque areas of the image 20.

An opaque base sheet 12 can be formed of card stock having a white reflective front surface 12*a*. In this case, a white shiny image area can be provided by the surface 12*a* itself without the necessity of printing the ink image 20 in this area. In an exemplary case of an image having a large white background, substantial economy can be realized by not having to print ink in the background area.

In the arrangement of FIG. 1, it is within the scope of the invention to form the textured pattern 14, adhesive layer 16, and reflective layer 18 first, and then form the ink image 20. Alternatively, the ink image 20 can be formed first, and then the pattern 14, layer 16 and reflective layer 18.

Figure 2:
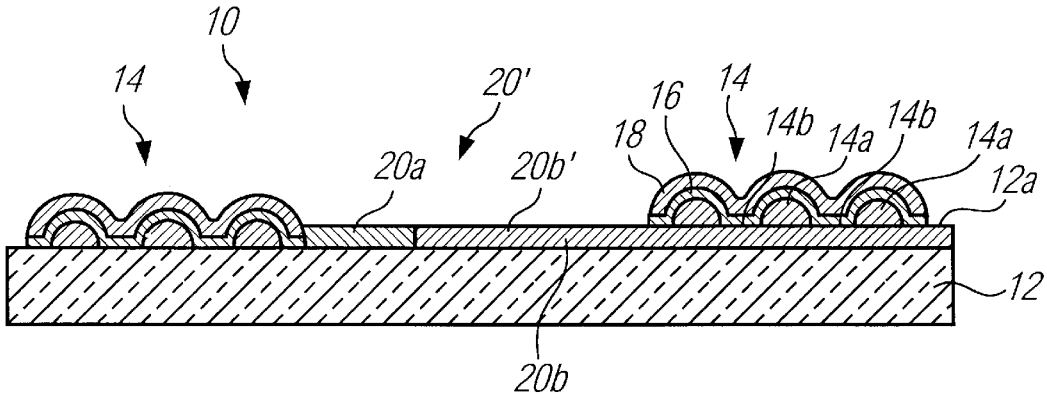
FIGS. 2 to 5 are cross-sectional views illustrating various modifications to the image display of FIG. 1 within the scope of the invention.

FIG. 2 illustrates a variation of the method of FIG. 1, in which an ink image 20' is formed first, and the pattern 14, layer 16 and reflective layer 18 are formed subsequently. Like elements are designated by the same reference numerals used in FIG. 1, whereas corresponding but modified elements are designated by the same reference numerals primed.

In this case, the overall processing may be facilitated by forming the ink image 20' over all or part of the surface 12*a*, and then forming the pattern 14, layer 16 and reflective layer 18 over all or part of the image 20'. As shown, a portion of the opaque layer 20*b'* extends under the right portion of the pattern 14. Thus, the textured pattern 14 is formed in a first area, the ink image 20' is formed in a second area, and the pattern 14 and image 20' overlap in a third area which is coextensive with the first area.

Figure 3:
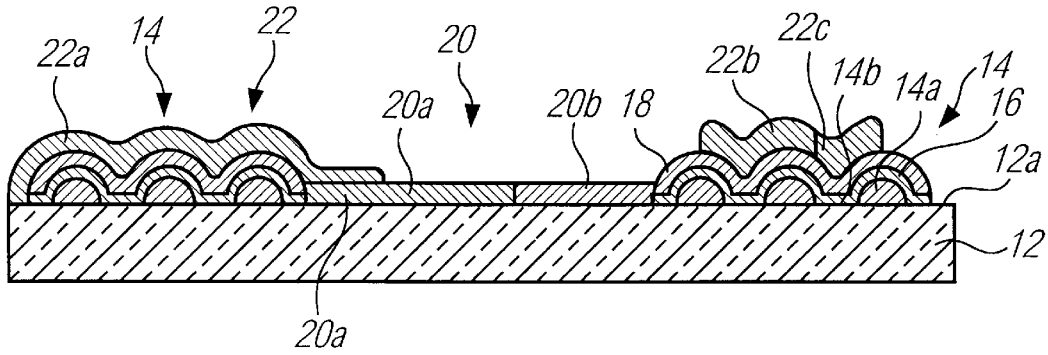

The method of the present invention can further include forming an additional ink image 22 over part or all of the roll leafing as illustrated in FIG. 3. The image 22 as shown includes a transparent area 22*a* which is formed over the left portion of the reflective layer 18 and the left portion of the ink image 20, a transparent area 22*b* which is formed over part of the right portion of the reflective layer 18, and an opaque area 22*c* which is formed over the right portion of the reflective layer 18.

The portion of the reflective layer 18 underlying the opaque area 22*c* will not be visible to a viewer. It is further within the scope of the invention to form the additional image 22 as including multiple layers as illustrated in FIG. 2, and to form transparent ink areas over opaque ink areas.

Figure 4:
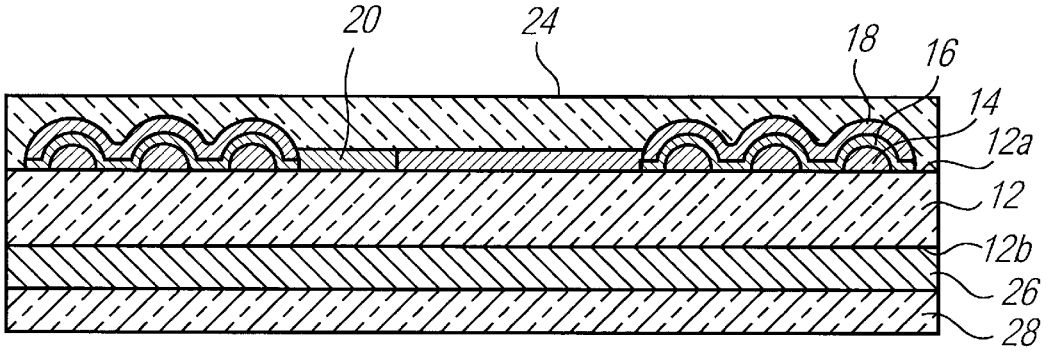

FIG. 4 further illustrates a protective transparent layer 24 which is formed over the reflective layer 18, image 20, and any exposed portions of the surface 12*a*. The layer 24 as illustrated is sufficiently thick that the method can further comprise planarizing the layer 24 in any known manner so that the exposed surface thereof is flat.

Figure 5:
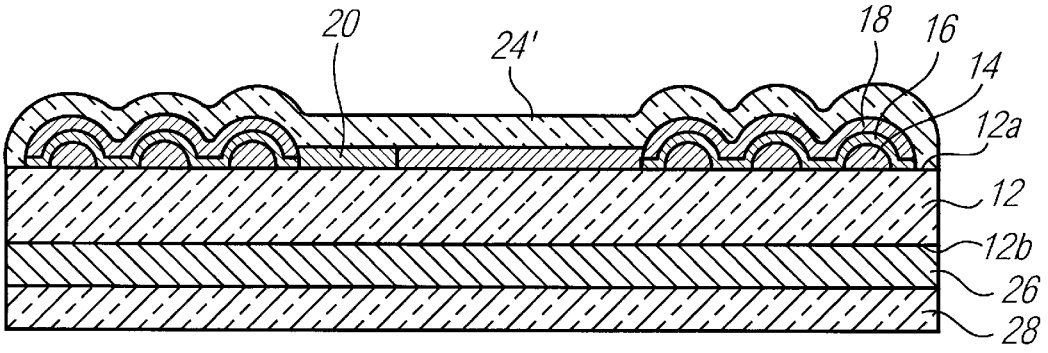

FIG. 5 illustrates an alternative transparent layer 24' which is thinner than the layer 24, and does not have a planar exposed surface. Instead, the exposed surface follows the underlying pattern 14 such that portions of the surface which overlie the protrusions 14*a* are raised to enhance the embossing effect.

The transparent layer 24 or 24' can be formed of any suitable material. Exemplary materials include transparent ink (either water based, UV curable or conventional solvent evaporative), catalyst and resin systems which produce a hard finish, and polyester, polyethylene, or polystyrene sheets. Transparent ink and catalyst and resin systems may be applied with a coater, by screen printing, spray painting, or using any other commercially available method, while the polyester sheet may be secured with a clear adhesive.

The thickness of transparent layer 24 or 24' may be varied in order to achieve the desired surface texture and appearance. If a relatively thin (approximately 1.0 to 2.0 mils) transparent layer 24' is employed, the top surface of the finished product will have a texture that corresponds to that of the textured pattern 14 as illustrated in FIG. 5.

A thicker (approximately 10.0 mils) transparent layer 24 gives the finished product the appearance of depth as illustrated in FIG. 4. If the layer 24 is sufficiently thick, it will not require a subsequent planarization step to produce a flat exposed surface.

The thickness of a transparent layer 24 or 24' applied with coaters may be varied by varying the number of coating layers applied. The thickness of a polyester sheet transparent layer will vary with the thickness of the sheet and the clear adhesive (either heat activated or pressure sensitive) which secures the sheet to the pattern 14 and image 20.

For example, the adhesive layer (not shown) may be as thin as 1.2 mils and the polyester sheet may be as thin as 0.25 mils, for a combined thickness of approximately 1.5 mils. Thicknesses of approximate 10.0 mils may be achieved with a 2.0 mil sheet and 8.0 mils of adhesive, with a 7.0 mil sheet and 3.0 mils of adhesive, and with all combinations therebetween.

FIGS. 4 and 5 further illustrate a layer 26 which is formed on a rear surface 12*b* of the sheet 12, and a protective transparent layer 28 which is formed over the layer 26. It will be noted that the layers 24, 24', 26, and/or 28 can be applied to any of the embodiments of FIGS. 2, 3 and 4 or any variations thereof, although not explicitly illustrated.

If the sheet 12 is transparent, the layer 26 can be an opaque layer of any color or pattern, or a shiny reflective or holographic layer. Where the layer 26 is opaque, it can provide a rear side ink image which is visible by viewing the sheet 12 from the front surface or the rear surface 12*b*, or from both surfaces.

The layer 26 is visible through any transparent areas of the image 20. If the layer 26 is opaque, the color of the transparent areas of the image 20 will be a combination of any tinting of the transparent areas and the color of the layer 26. If the layer 26 is reflective, the color of the transparent areas will be the color of the tinting, with a shiny metallic appearance to enhance the simulated depth effect.

It is further within the scope of the present invention to omit the reflective layer 26 in one or more areas to produce a clear or color tinted appearance which can be backlighted.

A preferred application of a visual display including an opaque base sheet 12 is a trading card, in which case the base sheet 12 will be made of cardboard or other suitable board stock. The front surface 12*a* of the sheet 12 will be white, or be of any other suitable color or pattern of colors. The layer 26 formed on the rear surface 12*b* will be a rear side ink image which is typically formed by printing. A suitable process for forming the rear side ink image is four color lithography. In this manner, images can be formed on both sides of the sheet 12 without resorting to lamination as in the prior art.

Figure 6:
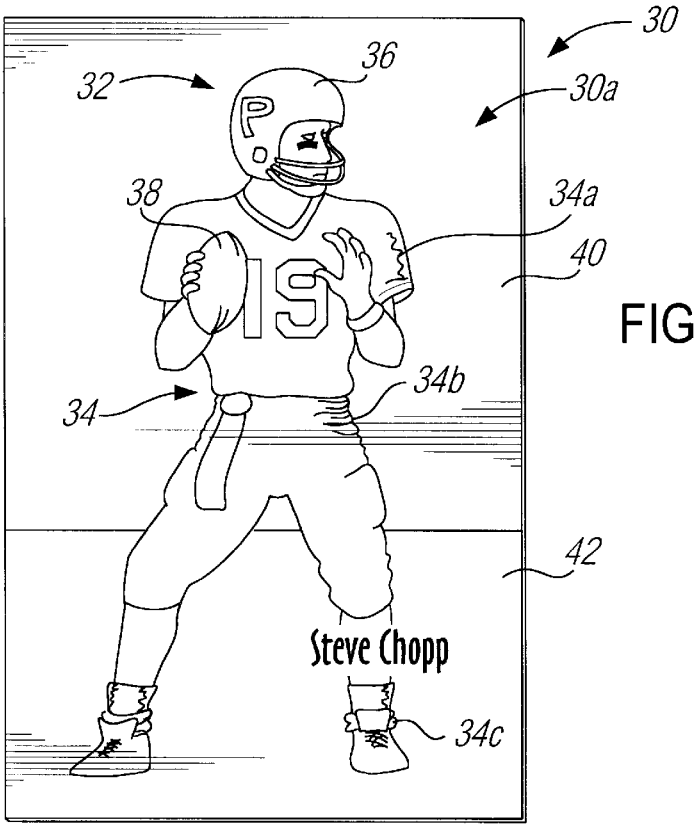
FIG. 6 is a front view of a trading card having an image display according to the invention.
Figure 7:
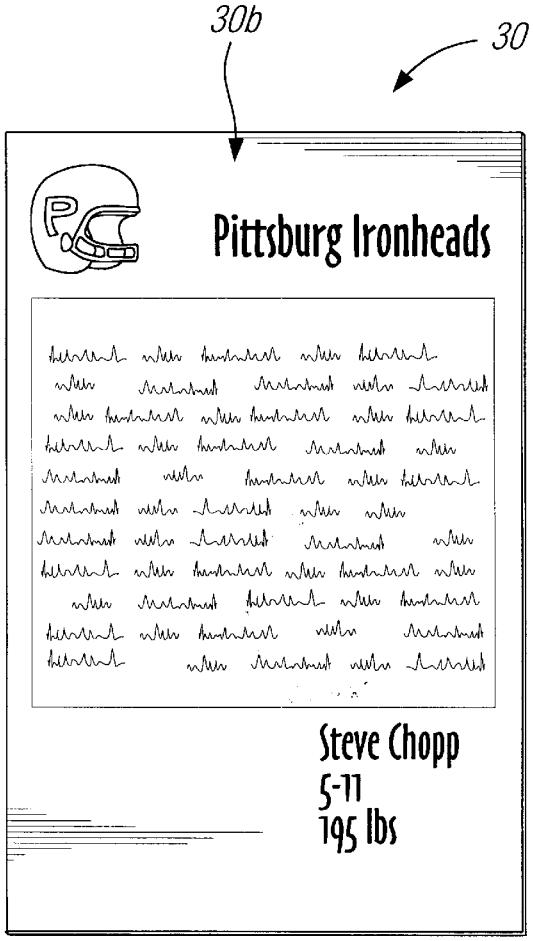
FIG. 7 is a rear view of the trading card of FIG. 6.
Figure 8:
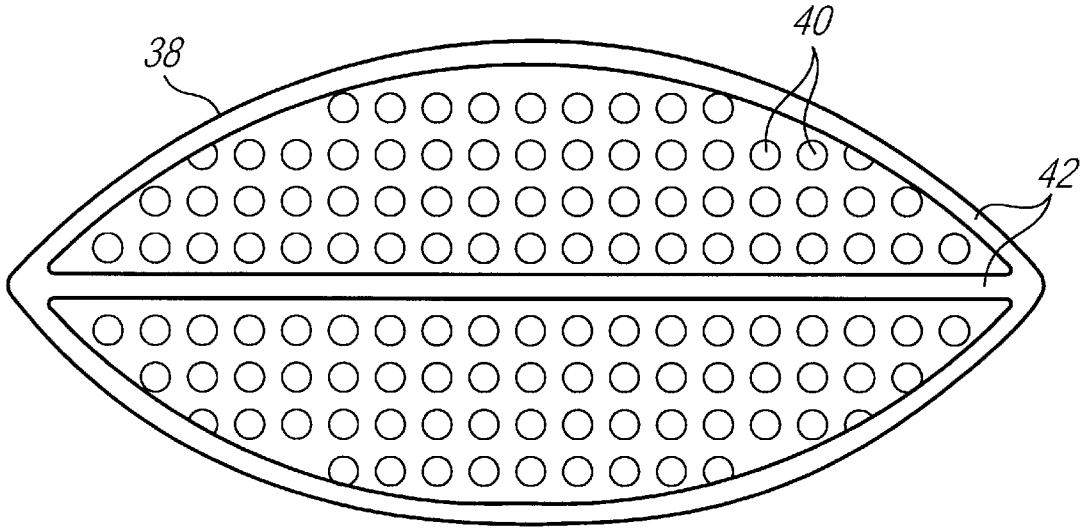
FIG. 8 is an enlarged fragmentary front view of the trading card illustrating details thereof.

An exemplary football trading card 30 is illustrated in FIGS. 6 to 8. FIG. 6 illustrates a front side 30*a* of the card 30 which has a textured image and an ink image formed thereon in the manner described above with reference to FIG. 1. FIG. 7 illustrates the rear side 30*b* of the card 30 which has an ink image printed thereon as described with reference to FIGS. 5 and 6.

The front side 30*a* of the card 30 includes a picture of a player 32 named Steve Chopp, whereas Steve's biographical data and statistics are printed on the rear side 30*b* of the card 30. As viewed in FIG. 6, the player 32 is wearing a uniform 34 and a helmet 36, and holding a football 38. Further visible is sky 40 and grass 42.

The front side 30*a* of the card 30 is formed by printing a textured pattern corresponding to the football 38 and other areas which are to be accentuated by simulated embossing. As illustrated in FIG. 8, the textured pattern of the football 38 typically comprises a plurality of distributed circular protrusions or bumps 40, and continuous protrusions 42 which depict the seams of the football 38.

Continuous linear ink protrusions are also formed to accentuate items such as portions 34*a* and 34*b* of the uniform 34, and shoelaces 34*c* as viewed in FIG. 6. After the textured pattern including the bumps 40 and protrusions 42, 34*a* to 34*c* has been printed on the front side 30*a* of the card 30, roll leafing is applied to the textured areas as described above.

Then, an ink image is formed on the front side 30*a* of the card 30, except for background and other areas which are to be constituted by the white or other colored surface of the front side 30*a* itself. For example, all areas except for the helmet 36 and football 38 can be formed of opaque ink, whereas transparent or translucent ink will be applied over the helmet 36 and football 38. Thus, the helmet 36 and football 38 will have a shiny appearance to simulate depth, whereas the football 38 and other textured areas will appear embossed to further enhance the simulated depth effect.

It is further within the scope of the invention to apply roll leafing to areas of the image which are not textured to provide flat, reflective image areas. Reflective and/or opaque ink can be selectively applied to portions of these areas as described above.

A protective transparent layer such as illustrated in FIGS. 4 or 5 can be formed on the side 30*a* if desired. The player's data is printed on the rear side 30*b* of the card 30 using a conventional lithographic or other suitable process in a separate operation. The rear side 30*b* can be printed before or after forming the front side 30*a*.

In summary, the present invention provides a method for producing a printed or similarly produced article, which overcomes the drawbacks of the prior art, and enables a pseudo three-dimensional visual display comprising a textured pattern including monochrome or holographic roll leafing to be formed on a surface of a base sheet which can be opaque as well as transparent.

The present invention enables a two-sided article, such as a trading card, poster, decal or sign, to be produced by printing an image on the side of the sheet opposite that which supports the textured pattern. This eliminates the need to laminate two separately printed articles to one another, the method presently used to produce two-sided cards.

Various modifications will become possible for those skilled in the art after receiving the teachings of the present disclosure without departing from the scope thereof. For example, the image layers can be formed using a technique other than ink printing, for example painting by hand.

I claim:

1. An image display, comprising:

a base having a front surface;

a textured pattern formed over a first area of the front surface;

a reflective layer adhered over the textured pattern; and an image formed over a second area of the front surface which is at least partially not occupied by the reflective layer.

2. A display as in claim 1, in which the reflective layer comprises roll leafing.

3. A display as in claim 1, in which the reflective layer comprises holographic roll leafing.

4. A display as in claim 1, in which the reflective layer is holographic.

5. An image display, comprising:

a base having a front surface;

a textured pattern formed over a first area of the front surface;

a reflective layer formed over the textured pattern; and an image formed over a second area of the front surface;

in which the first and second areas overlap in a third area.

6. A display as in claim 5, in which the textured pattern and the reflective layer are formed over the image in the third area.

7. A display as in claim 6, in which the third area is substantially coextensive with the first area.

8. A display as in claim 5, in which the image overlaps the textured pattern and the reflective layer in the third area.

9. A display as in claim 1, further comprising an adhesive for adhering the reflective layer to the textured pattern.

10. An image display, comprising:

a base having a front surface;

a textured pattern formed over a first area of the front surface;

a reflective layer formed over the textured pattern; and an image formed over a second area of the front surface;

in which the textured pattern comprises a plurality of protrusions formed over the front surface; and the reflective layer is formed over the protrusions and portions of the front surface between the protrusions in the first area.

11. A display as in claim 10, in which the protrusions are formed of ink.

12. A display as in claim 1, in which the image comprises an opaque area.

13. A display as in claim 1, in which the image comprises an at least partially transparent area.

14. A display as in claim 1, in which the image comprises opaque and at least partially transparent areas.

15. A display as in claim 1, in which the image is formed of ink.

16. A display as in claim 1, further comprising an additional image formed over at least a portion of the reflective layer.

17. A display as in claim 16, in which the additional image comprises an opaque area.

18. A display as in claim 16, in which the additional image comprises an at least partially transparent area.

19. A display as in claim 16, in which the additional image comprises opaque and at least partially transparent areas.

20. A display as in claim 16, in which the additional image is formed of ink.

21. A display as in claim 1, further comprising a transparent layer formed over the reflective layer and the image.

22. A display as in claim 21, in which the transparent layer has a planar exposed surface.

23. A display as in claim 21, in which the transparent layer has an textured exposed surface which follows the textured pattern.

24. A display as in claim 1, in which the base is opaque.

25. A display as in claim 24, in which the front surface is colored.

26. An image display comprising:

a base having a front surface;

a textured pattern formed over a first area of the front surface;

a reflective layer formed over the textured pattern; and an image formed over a second area of the front surface;

in which the base is at least partially transparent and has a rear surface which is opposite to the front surface; and the display further comprises an additional reflective layer formed over the rear surface.

27. An image display, comprising:

a base having a front surface;

a textured pattern formed over a first area of the front surface;

a reflective layer formed over the textured pattern; and an image formed over a second area of the front surface;

in which the base is at least partially transparent and has a rear surface which is opposite to the front surface; and the display further comprises a holographic layer formed over the rear surface.

* * * * *